US010126050B2

(12) United States Patent
Jensen

(10) Patent No.: US 10,126,050 B2
(45) Date of Patent: Nov. 13, 2018

(54) METHOD AND SYSTEM FOR DRYING PARTICULATE MATERIAL

(71) Applicant: ASJ-IPR ApS, Kgs. Lyngby (DK)

(72) Inventor: Arne Sloth Jensen, Kgs. Lyngby (DK)

(73) Assignee: ASJ-IPR APS, Kgs. Lyngby (DK)

( * ) Notice: Subject to any disclaimer, the term of this patent is extended or adjusted under 35 U.S.C. 154(b) by 724 days.

(21) Appl. No.: 14/271,078

(22) Filed: May 6, 2014

(65) Prior Publication Data

US 2014/0325869 A1 Nov. 6, 2014

(30) Foreign Application Priority Data

May 6, 2013 (EP) ..... 13166629

(51) Int. Cl.
*F26B 3/02* (2006.01)
*F26B 17/10* (2006.01)
(Continued)

(52) U.S. Cl.
CPC ..... *F26B 3/02* (2013.01); *F26B 17/10* (2013.01); *F26B 21/005* (2013.01); *F26B 21/02* (2013.01)

(58) Field of Classification Search
CPC ..... F26B 3/02; F26B 17/10; F26B 21/005; F26B 21/02
See application file for complete search history.

(56) References Cited

U.S. PATENT DOCUMENTS 4,602,438 A 7/1986 Draper et al.
4,785,554 A * 11/1988 Hederer ..... F26B 17/006 34/164

(Continued)

FOREIGN PATENT DOCUMENTS

AT 345769 10/1978
EP 0153704 9/1985

(Continued)

OTHER PUBLICATIONS

Jensen, Arne Sloth; "Steamdrying of Beet Pulp, Larger Units, No Air Pollution, and Large Reduction of $CO_2$ Emission"; Association Andrew VanHook, Maison des Agriculteurs, Reims, France; Symposium AVH 2008.

(Continued)

*Primary Examiner* — Jianying Atkisson
*Assistant Examiner* — Tavia Sullens
(74) *Attorney, Agent, or Firm* — Klein, O'Neill & Singh, LLP

(57) ABSTRACT

A system for drying moist, particulate material includes a steam dryer having a container containing superheated steam. Upper and lower heat exchangers, with a channel extending through them, are located in the container. An impeller generates a flow of steam upward in the container outside the heat exchangers and downward through the channel. Guide plates around the heat exchangers guide the moist, particulate material from an inlet in the lower part of the container around the heat exchangers, subjecting the material to the flow of the steam, thereby drying the material. A steam conduit supplies a primary steam flow to the lower heat exchanger, which condenses the primary steam flow into a flow of hot water that is directed to a flow generator that generates a fluid flow from the hot water flow. A fluid conduit leads the fluid flow to the upper heat exchanger.

13 Claims, 6 Drawing Sheets

(51) Int. Cl.
*F26B 21/02* (2006.01)
*F26B 21/00* (2006.01)

(56) References Cited

U.S. PATENT DOCUMENTS

| | | | |
|---|---|---|---|
| 4,813,155 | A | 3/1989 | Jensen et al. |
| 5,357,686 | A | 10/1994 | Jensen |
| 6,154,979 | A | 12/2000 | Jensen |
| 6,266,895 | B1 | 7/2001 | Jensen |
| 6,438,863 | B1 | 8/2002 | Jensen |
| 6,966,466 | B2 | 11/2005 | Jensen |
| 7,578,073 | B2 | 8/2009 | Krell et al. |

FOREIGN PATENT DOCUMENTS

| | | |
|---|---|---|
| EP | 0268819 | 6/1988 |
| EP | 0537262 | 5/1994 |
| EP | 0955511 | 11/1999 |
| EP | 1070223 | 2/2005 |
| EP | 1044044 | 3/2008 |
| EP | 2457649 | 5/2012 |
| WO | WO2010/139331 | 12/2010 |

OTHER PUBLICATIONS

Examination Report on corresponding European application (EP 14167015.8) from the European Patent Office dated May 20, 2016.
Search Report from EPO on co-pending EP application (EP13166629.9) dated Oct. 10, 2013.

* cited by examiner

METHOD AND SYSTEM FOR DRYING PARTICULATE MATERIAL

CROSS-REFERENCE TO RELATED APPLICATIONS

Not Applicable

BACKGROUND

The present invention relates to the drying of particulate material, and in particular to the drying of particulate sugar beet pulp.

According to the teachings of the present invention, the efficiency of the drying of particulate material may be improved by 10-15%, and possibly even more, when comparing the operation of a steam dryer according to the present invention with the operation of a steam dryer according to the prior art, for example steam dryers disclosed in EP 0 153 704, EP 0 537 262(A1), EP 0 955 511 (A3), EP 1 044 044 (A1), EP 1 070 223 (A1), EP 1 956 326 (B1), EP 2 457 649 (A1), U.S. Pat. No. 4,813,155, U.S. Pat. No. 5,357,686 (A), U.S. Pat. No. 6,154,979(A), U.S. Pat. No. 6,266,895 (B1), U.S. Pat. No. 6,438,863(B1), U.S. Pat. No. 6,966,466 (B2), U.S. Pat. No. 7,578,073 (B2) and WO2010139331 (A2).

Reference is made to the above patent applications and patents, and the above US patents are hereby incorporated in the present specification by reference.

It is an object of the present invention to improve the efficiency in drying particulate material. In particular, it is an object of the present invention to improve the energy efficiency of a steam dryer for drying particulate sugar beet pulp.

The above objects are according to a first aspect of the present invention achieved by a method of drying humid particulate material, the method comprising:

providing a supplier of pressurized steam, and a steam dryer for drying the humid particulate material, the steam dryer comprising: a closed container maintaining an atmosphere comprising superheated steam at an elevated pressure, the closed container comprising a lower cylindrical part and an upper cylindrical part, a heat exchanger assembly located inside the closed container and comprising a channel for allowing the superheated steam to be transported from inside the upper cylindrical part to inside the lower cylindrical part, the heat exchanger assembly comprising a first heat exchanger and a second heat exchanger for heating the superheated steam, the first heat exchanger being positioned above the second heat exchanger and the channel going down through the first and second heat exchangers and a plurality of guide plates positioned upright and circumferentially around the heat exchanger;

the method comprising: supplying a primary flow of steam from the supplier to the second heat exchanger for heating the second heat exchanger and condensing the primary flow of steam within the second heat exchanger into a flow of condensed hot water; discharging the flow of condensed hot water from the second heat exchanger, generating a first flow of fluid exclusively from the flow of condensed hot water; leading the first flow of fluid to the first heat exchanger for heating the first heat exchanger; generating a flow of the superheated steam by means of an impeller going upwards on the outside of the heat exchanger assembly to the inside of the upper cylindrical part and downwards through the channel; feeding the humid particulate material into the lower cylindrical part of the closed container; guiding the humid particulate material by means of the plurality of guide plates positioned upright and circumferentially around the heat exchanger along a path around the heat exchanger assembly for subjecting the humid particulate material to the flow of the superheated steam for converting the humid particulate material into dry particulate material; and removing the dry particulate material from the closed container.

According to the basic teachings of the present invention, the improvement of the efficiency of the drying of particulate material by using a steam dryer is improved by more than 10%, such as 10-15%, or possibly even more by employing a heat exchanger assembly comprising at least two separate heat exchangers or heat exchanger sections positioned so that the one being the first heat exchanger or heat exchanger section is positioned above the second heat exchanger or heat exchanger section, and the heating medium, i.e., the steam introduced into the heat exchanger assembly, being input to the second or lower heat exchanger or heat exchanger section, the water discharge from which is used for generating a flow of fluid, i.e., steam or hot water input to the first heat exchanger or heat exchanger section, i.e., the upper-most located heat exchanger or heat exchanger section. The use of the heat exchanger assembly according to the present invention has surprisingly brought about substantive efficiency improvements, which improvement or use of two heat exchangers or two separate heat exchanger sections in accordance with the teachings of the present invention is not known to have been disclosed beforehand.

Examples of moist particulate material, normally non-homogenous materials suitable for being dried in accordance with the teachings of the present invention are: wood chips, wood pulp, bark chips, sugar beet pulp, sludge, wet distillers grain, bagasse, chopped or otherwise particulate material of alfalfa or other plants or vegetables, fish meal or the like, or even combinations of the above materials with other ingredients or materials. Preferably, the particulate material is sugar beet pulp.

The supplier of steam may be a boiler, or an outlet of steam in another system utilizing pressurized steam, for example, an outlet of a turbine.

The generating of the first flow of fluid may comprise forming the first flow of fluid comprising the flow of condensed hot water or at least a part of the condensed hot water. This way, the first heat exchanger will be fed by hot water having a lower temperature than the steam fed to the second heat exchanger. The flow of the superheated steam passes through the first heat exchanger before it reaches the second heat exchanger. This means that the first heat exchanger effectively has the function of a pre-heater, which improves the efficiency. Alternatively, the generating of the first flow of fluid may comprise separating the flow of condensed hot water into a first steam component and a first water component, and forming the first flow of fluid comprising the first steam component or at least a part of the first steam component. This way, the first heat exchanger will be fed by steam having a lower temperature than the steam fed to the second heat exchanger. Therefore, the first heat exchanger also has the function of a pre-heater in this alternative, which improves the efficiency of the heating. In both of the alternatives the first heat exchanger is positioned upstream from the second heat exchanger with respect to the flow of the superheated steam, which means that the heat exchanger assembly has the function of a parallel heat exchanger in which the temperature gradient of the heat exchanger is decreasing with an increasing temperature gradient of the superheated steam, which improves the efficiency of the heating.

The method according to the first aspect of the present invention may further comprise leading a second flow of fluid from the first heat exchanger, the second flow of fluid comprising water from the first flow of fluid, and separating a second steam component and a second water component from the second flow of fluid. This separation gives further control over the energy transfer in the system.

The supplier of pressurized steam may be a boiler, and the method may further comprise forming a third flow of fluid from the second water component, leading the third flow of fluid to the boiler, and generating at least a portion of the pressurized steam from the third flow of fluid in the boiler. This means that the water fed to the boiler will be pre-heated from waste heat generated in the drying, which will improve the overall energy efficiency of the drying.

The term "guide plate" as used in the present specification is to be understood as a generic term including evidently technical solutions encompassed by the literal understanding of the term, and also plates or walls serving to divide the closed container into several compartments and serving to control the transfer and transport of the moist particulate material within the cylindrical parts of the closed container, and in particular to control the time of rest of the particulate material in the individual compartments and as described per se in several of the above listed patent applications and patents.

The term "upright" as used in the present specification is to be understood as a generic term including evidently technical solutions encompassed by the literal understanding of the term, and also orientations which are not strictly vertical, however, differing from a horizontal orientation and also including sloping orientations defined by the guide plate or guide plates.

The expression "a plurality of guide plates positioned upright and circumferentially around the heat exchanger" as used in the present specification is to be understood as encompassing not only the literal understanding of the expression, but also technical solutions such as guide plates having any geometrical configuration, including planer plates, curved or partially curved and planar plates, or plates including one or more sections which are bent along a straight or curved line from the orientation of the remaining part of the plate, and in addition, the upright position of the plate is to encompass any overall orientation of the plate relative to the supporting horizontal plane, e.g., defined by the geometrical center line of the geometrical structure or the plane defined by a part, in particular the major part, of the guide plate.

The method according to the first aspect of the present invention may further comprise forming a fourth flow of fluid from the flow of condensed hot water, leading the fourth flow of fluid to the primary flow of steam, and mixing the fourth flow of fluid into the primary flow of steam. The mixing will have the effect that the temperature and/or pressure of the pressurized steam is lowered to be suitable for the steam dryer, which means that the supplier of steam can deliver steam with a higher temperature and/or pressure that is suitable for other applications, for example driving a turbine. This will improve the overall efficiency of the system.

The method according to the first aspect of the present invention may further comprise forming a fifth flow of fluid from the first water component and/or leading a sixth flow of fluid from the first heat exchanger comprising water condensed from the first flow of fluid, and separating a third steam component and a third water component from the fifth flow of fluid and/or the sixth flow of fluid. This separation gives further control over the energy transfer in the system.

The supplier of pressurized steam may be a boiler, and the method may further comprise forming a seventh flow of fluid from the third water component, leading the seventh flow of fluid to the boiler, and generating at least a portion of the pressurized steam from the seventh flow of fluid in the boiler. This means that the water fed to the boiler will be pre-heated from waste heat generated in the drying, which will improve the overall energy efficiency of the drying.

The method according to the first aspect of the present invention may further comprise forming an eighth flow of fluid from the first water component, leading the eighth flow of fluid to the primary flow of steam, and mixing the eighth flow of fluid into the primary flow of steam. The mixing will have the effect that the temperature and/or pressure of the pressurized steam is lowered to be suitable for the steam dryer, which means that the supplier of steam can deliver steam with a higher temperature and/or pressure that is suitable for other applications, for example driving a turbine. This will improve the overall efficiency of the system.

The method according to the first aspect of the present invention may further comprise providing a primary evaporation unit for reducing the water content of a first juice comprising sugar, and leading a first exhaust flow from the closed container to the primary evaporation unit for heating the primary evaporation unit, the first exhaust flow comprising steam from the superheated steam.

The method according to the first aspect of the present invention may further comprise providing a secondary evaporation unit for reducing the water content of a second juice comprising sugar, and supplying a secondary flow of steam from the supplier to the secondary evaporation unit for heating the secondary evaporation unit.

The method according to the first aspect of the present invention may further comprise providing the first juice as input to the primary evaporation unit, providing the second juice as output from the primary evaporation unit, the second juice comprising sugar from the first juice, and providing the second juice as input to the secondary evaporation unit.

The method according to the first aspect of the present invention may further comprise providing a tertiary evaporation unit for reducing the water content of a third juice comprising sugar, and/or leading a second exhaust flow from the primary evaporation unit to the tertiary evaporation unit for heating the tertiary evaporation unit, the second exhaust flow comprising steam evaporated from the first juice, and/or leading a third exhaust flow from the secondary evaporation unit to the tertiary evaporation unit for heating the tertiary evaporation unit, the third exhaust flow comprising steam evaporated from the second juice.

The method according to the first aspect of the present invention may further comprise providing the third juice as output from the secondary evaporation unit, the third juice comprising sugar from the second juice, and providing the third juice as input to the tertiary evaporation unit.

The method according to the first aspect of the present invention may further comprise forming a ninth flow of fluid from the second steam component, and leading the ninth flow of fluid to the secondary evaporation unit for heating the secondary evaporation unit.

The method according to the first aspect of the present invention may further comprise forming a tenth flow of fluid from the third steam component, and leading the tenth flow of fluid to the secondary evaporation unit for heating the secondary evaporation unit.

The above objects are according to a second aspect of the present invention are achieved by a system of drying humid particulate material, the system comprising: a supplier of pressurized steam and a steam dryer for drying the humid particulate material;

the steam dryer comprising: a closed container for maintaining an atmosphere comprising superheated steam at an elevated pressure, the closed container comprising a lower cylindrical part and an upper cylindrical part; a heat exchanger assembly located inside the closed container and comprising a channel for allowing the superheated steam to be transported from inside the upper cylindrical part to inside the lower cylindrical part, the heat exchanger assembly comprising a first heat exchanger and a second heat exchanger for heating the superheated steam, the first heat exchanger being positioned above the second heat exchanger and the channel going down through the first and second heat exchangers; an impeller for generating a flow of the superheated steam going upward on the outside of the heat exchanger assembly to the inside of the upper cylindrical part and downward through the channel; a material inlet for feeding the moist particulate material into the lower part of the closed container; a plurality of guide plates positioned upright and circumferentially around the heat exchanger for guiding the moist particulate material along a path around the heat exchanger assembly for subjecting the moist particulate material to the flow of the superheated steam for converting the moist particulate material into dry particulate material; and a material outlet for removing the dry particulate material from the closed container; and the system further comprising: a first steam conduit for supplying a primary flow of steam from the supplier to the second heat exchanger for heating the second heat exchanger and the second heat exchanger being adapted for condensing the primary flow of steam into a flow of condensed hot water; a hot water outlet for discharging the flow of condensed hot water from the second heat exchanger; a first flow generator for generating a first flow of fluid exclusively from the flow of condensed hot water; and a first fluid conduit for leading the first flow of fluid to the first heat exchanger for heating the first heat exchanger.

The first flow generator may be adapted for forming the first flow of fluid comprising the flow of condensed hot water or at least a part of the condensed hot water. Alternatively, the first flow generator may comprising: a first flasher for separating the flow of condensed hot water into a first steam component and a first water component, and the first flow generator may be adapted for forming the first flow of fluid comprising the first steam component or at least a port of the first steam component.

The system according to the first aspect of the present invention may further comprise a second fluid conduit for leading a second flow of fluid from the first heat exchanger to a second flasher for separating a second steam component and a second water component from the second flow of fluid, the second flow of fluid comprising water from the first flow of fluid.

The supplier of pressurized steam may be a boiler, the second flasher further may be adapted for forming a third flow of fluid from the second water component, and the system may further comprise a third fluid conduit for leading the third flow of fluid from the second flasher to the boiler, and the boiler may be adapted for generating at least a portion of the pressurized steam from the third flow of fluid in the boiler.

The first flow generator may further be adapted for forming a fourth flow of fluid from the flow of condensed hot water, the system may further comprise a fourth fluid conduit for leading the fourth flow of fluid from the second flasher to the primary flow of steam, and a first mixer for mixing the fourth flow of fluid into the primary flow of steam.

The first flasher may further be adapted for forming a fifth flow of fluid from the first water component, and the system may further comprise a third flasher; a fifth fluid conduit for leading the fifth flow of fluid from the first flasher to the third flasher, and/or a sixth fluid conduit for leading a sixth flow of fluid from the first heat exchanger to the third flasher, the sixth flow of fluid comprising water condensed from the first flow of fluid, and the third flasher being adapted for separating a third steam component and a third water component from the fifth flow of fluid and/or the sixth flow of fluid.

The supplier of pressurized steam may be a boiler, the third flasher may further be adapted for forming a seventh flow of fluid from the third water component, and the system may further comprise a seventh fluid conduit for leading the seventh flow of fluid from the third flasher to the boiler, and the boiler may further be adapted for generating at least a portion of the pressurized steam from the seventh flow of fluid in the boiler.

The first flasher may further be adapted for forming an eighth flow of fluid from the first water component, and the system may further comprise an eighth fluid conduit for leading the eighth flow of fluid from the third flasher to the primary flow of steam, and a second mixer for mixing the eighth flow of fluid into the primary flow of steam.

The system according to the second aspect of the present invention may further comprise a primary evaporation unit for reducing the water content of a first juice comprising sugar, and a first exhaust conduit for leading a first exhaust flow from the closed container to the primary evaporation unit for heating the primary evaporation unit, the first exhaust flow comprising steam from the superheated steam.

The system according to the second aspect of the present invention may further comprise a secondary evaporation unit for reducing the water content of a second juice comprising sugar, and a second steam conduit for supplying a secondary flow of steam from the supplier to the secondary evaporation unit for heating the secondary evaporation unit.

The system according to the second aspect of the present invention may further comprise a first juice conduit for leading the first juice to the primary evaporation unit, a first juice inlet for receiving the first juice as input to the primary evaporation unit, a first juice outlet for removing the second juice as output from the primary evaporation unit, the second juice comprising sugar from the first juice, a second juice conduit for leading the second juice to the secondary evaporation unit, and a second juice inlet for receiving the second juice as input to the secondary evaporation unit.

The system according to the second aspect of the present invention may further comprise a tertiary evaporation unit for reducing the water content of a third juice comprising sugar, and a second exhaust conduit for leading a second exhaust flow from the primary evaporation unit to the tertiary evaporation unit for heating the tertiary evaporation unit, the second exhaust flow comprising steam evaporated from the first juice, and a third exhaust conduit for leading a third exhaust flow from the secondary evaporation unit to the tertiary evaporation unit for heating the tertiary evaporation unit, the third exhaust flow comprising steam evaporated from the second juice.

The system according to the second aspect of the present invention may further comprise a second juice outlet for removing the third juice as output from the secondary evaporation unit, the third juice comprising sugar from the second juice, a third juice conduit for leading the third juice to the tertiary evaporation unit, and a third juice inlet for receiving the third juice as input to the tertiary evaporation unit.

The second flasher may further be adapted for forming a ninth flow of fluid from the second steam component, and the system may further comprise a ninth fluid conduit for leading the ninth flow of fluid to the secondary evaporation unit for heating the secondary evaporation unit.

The third flasher may further be adapted to form a tenth flow of fluid from the third steam component and the system may further comprise a tenth fluid conduit for leading the tenth flow of fluid to the secondary evaporation unit for heating the secondary evaporation unit.

The system according to the second aspect of the present invention may further comprise a generator for generating electricity, and said second steam conduit may comprise a generator for being driven by said secondary flow of steam for driving said generator.

DETAILED DESCRIPTION

Figure 1:
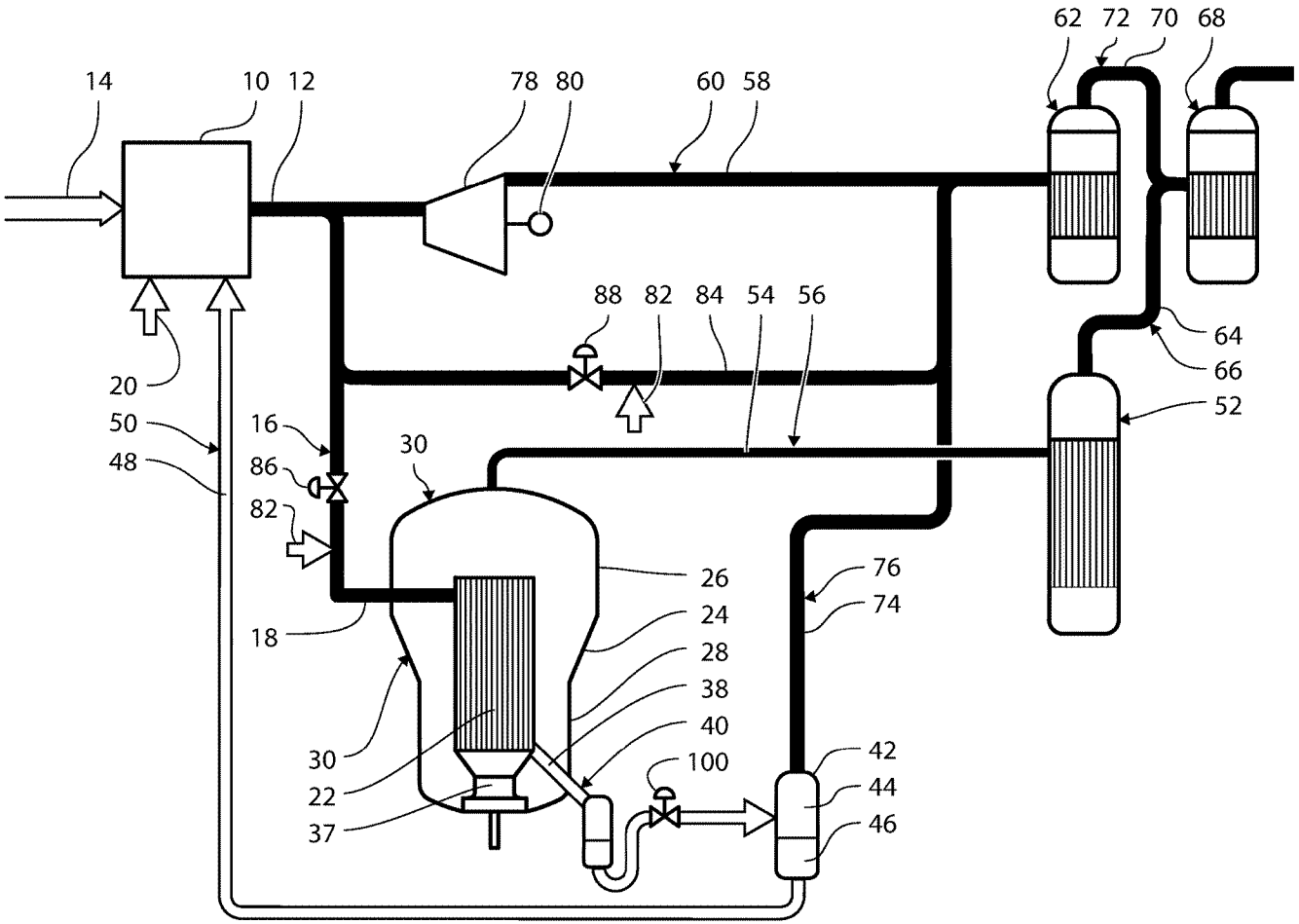
FIG. 1 (PRIOR ART)
FIG. 1 illustrates a known system for drying particulate sugar beet pulp.

FIG. 1 illustrates a known system for drying particulate sugar beet pulp. In the drawings, conduits are shown and throughout the drawings, conduits having a black signature, i.e. being drawn in solid black lines, are conduits conducting steam, whereas conduits having a white signature represent conduits conducting water. The system has a boiler 10 generating pressurized steam 12 from a supply of water 20 by heat 14 supplied from a burner. A first steam conduit 16 supplies a primary flow of steam 18 to a steam dryer 30. The steam dryer 30 has a closed container 24 that can hold an atmosphere at an elevated temperature and at a pressure at which water is in the form of superheated steam. A heat exchanger 22 is positioned inside the closed container 24, and the first steam conduit 16 supplies the primary flow of steam 18 to the heat exchanger 22. The heat exchanger 22 in turn heats the atmosphere inside the closed container 24.

The steam dryer 30 has a material inlet (not shown in the drawings), through which humid or moist sugar beet pulp is supplied into the closed container 24, and a material outlet (not shown in the drawings), through which dried sugar beet pulp is extracted from the closed container 24. The material inlet and material outlet are both shown in FIG. 6. When the moist sugar beet pulp is subjected to the heated atmosphere inside the closed container 24, it expels water in the form of steam that is brought to superheated temperature by the heat exchanger 22.

The heat exchanger 22 has a channel or a plurality of channels for leading the superheated steam from an upper cylindrical part 26 to a lower cylindrical part 28 of the closed container. An impeller 37 is positioned below the heat exchanger 22 and drives a flow of superheated steam up on the outside of the heat exchanger 22 and down through the channel in the heat exchanger 22.

When subjected to the flow of superheated steam, the moist particulate beet pulp is guided from the material inlet around the heat exchanger 22 to the material outlet, during which the particulate beet pulp is dried.

The heat exchanger condenses the primary flow of steam 18 into a flow of condensed water 38. A hot water conduit 40 leads the flow of condensed water 38 from the steam dryer 30 at a reduced pressure to a flasher 42 through a valve 100, so that the flow of condensed water 38 is separated into a steam component 44 and a water component 46.

The flasher 42 forms a flow of fluid 48 from the water component 46, and a fluid conduit 50 leads the flow of fluid 48 from the flasher 42 to the boiler 10, which converts it to pressurized steam.

A first exhaust flow 54 of steam leads steam from the superheated steam inside the closed container 24 via a first exhaust conduit 56 to a primary evaporation unit 52. The heat transferred this way is employed in the primary evaporation unit 52 to reduce the water contents of a first juice produced from dried particulate sugar beet pulp to increase the sugar concentration of the juice.

A turbine 78 is supplied with pressurized steam 12 from the boiler 10 and provides a second flow of steam 58 that is led via a second steam conduit 60 to a secondary evaporation unit 62. A flow of fluid 74 in the form of steam from the steam component generated by the flasher 42 is also led via a fluid conduit 76 to the secondary evaporation unit 62. The heat transferred this way is employed in the secondary evaporation unit 62 to reduce the water contents of a second juice that is the output with increased sugar concentration from the primary evaporation unit 52.

A second exhaust flow 64 of steam evaporated from the first juice is led from the primary evaporation unit 52 via a second exhaust conduit 66 to a tertiary evaporation unit 68. Similarly, a third exhaust flow 70 of steam evaporated from the second juice is led from the secondary evaporation unit 62 via a third exhaust conduit 72 to a tertiary evaporation unit 68. The heat transferred this way is employed in the tertiary evaporation unit 68 to reduce the water contents of a third juice that is the output with increased sugar concentration from the secondary evaporation unit 62.

The turbine 78 mentioned above in turn drives a generator 80 that generates electricity. A bypass conduit 84 controlled by a bypass valve 88 may lead pressurized steam 12 from the boiler 10 to the second evaporation unit 62 bypassing the turbine 78. Cooling water 82 may be added to the bypass conduit 84. The primary flow of steam is controlled by a primary valve 86 installed in the first steam conduit 16.

Figure 2:
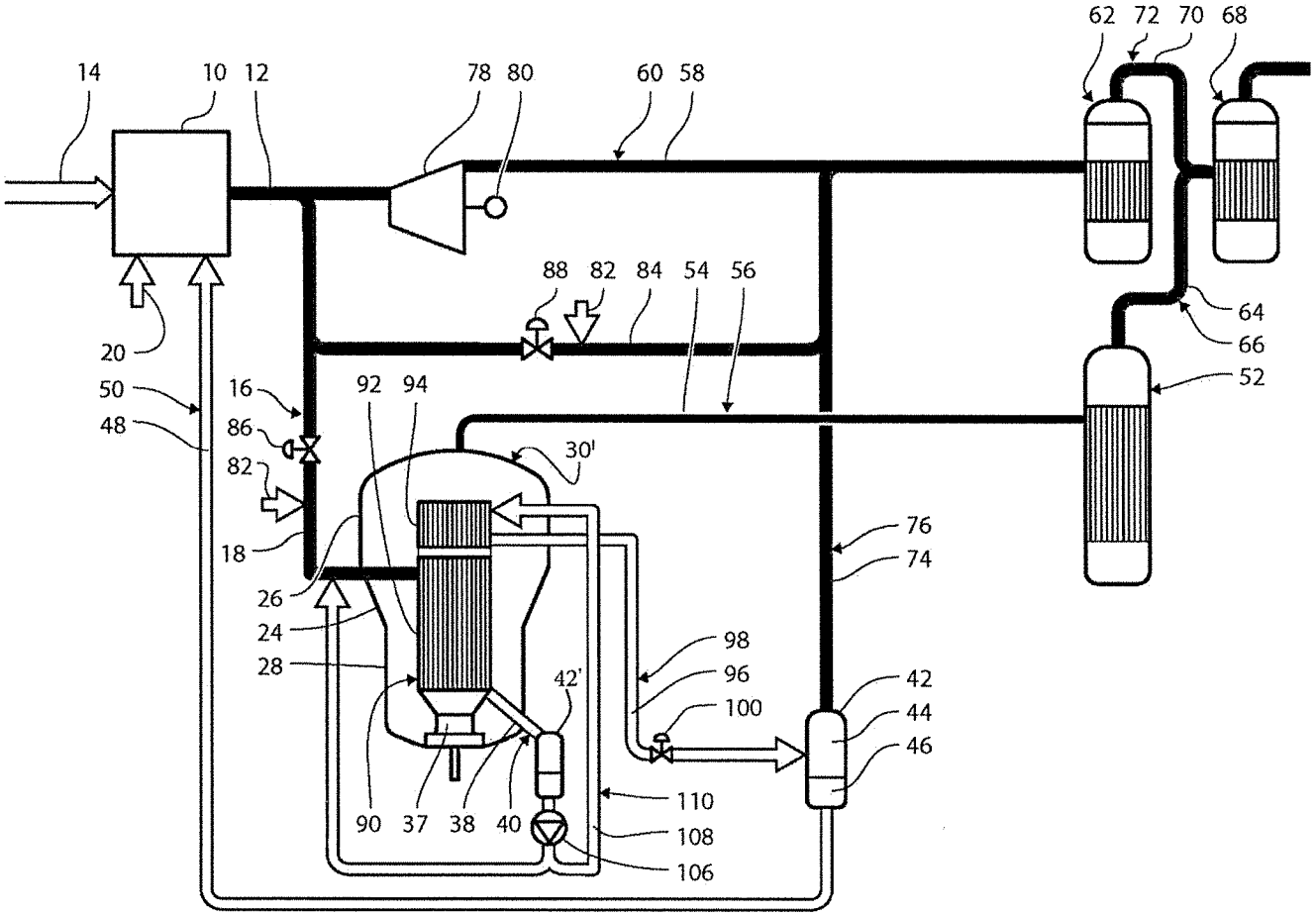
FIG. 2 illustrates a first embodiment of a system according to the present invention for drying particulate sugar beet pulp according to a first embodiment of the present invention.
Figure 3:
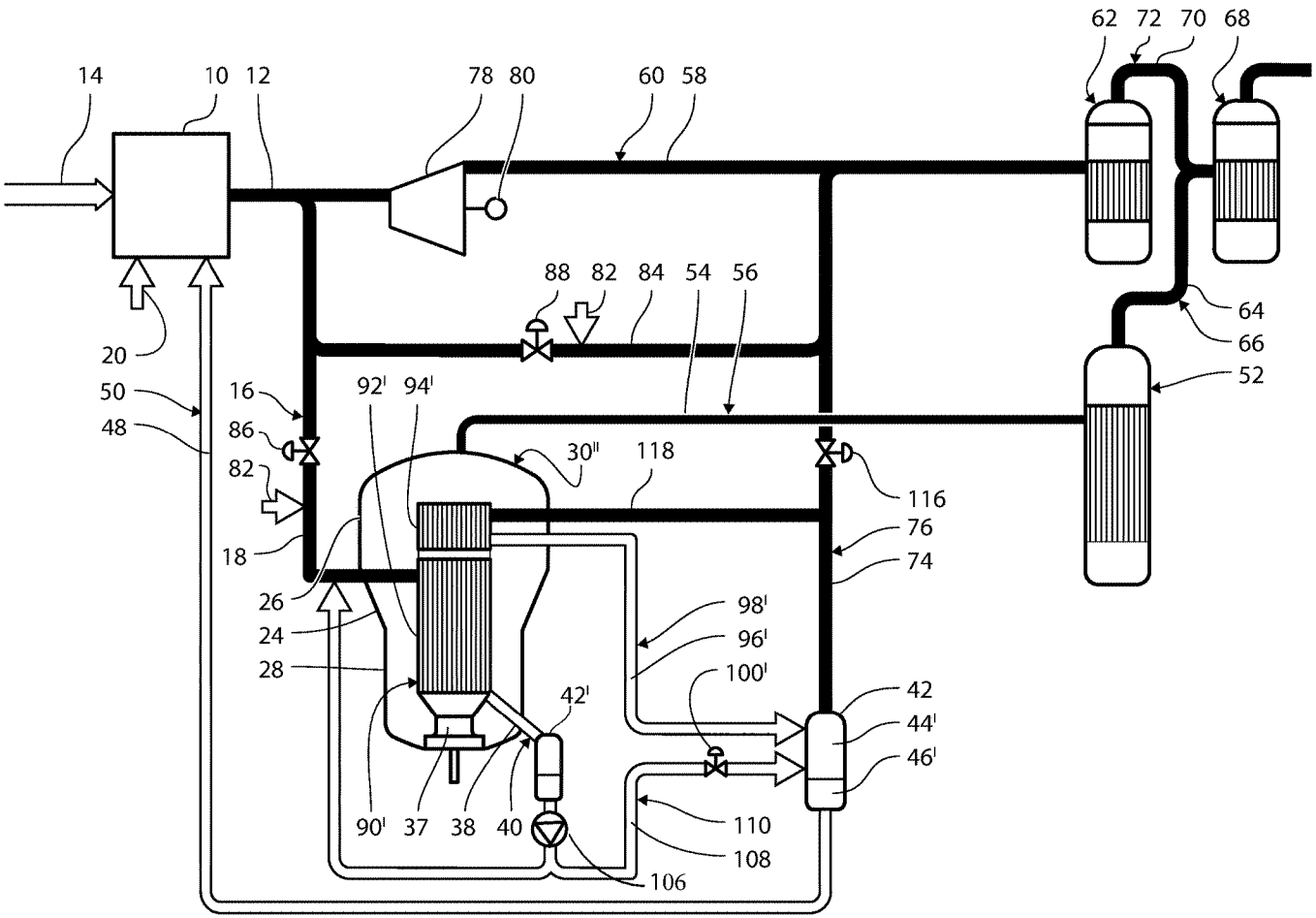
FIG. 3 illustrates a second and presently preferred embodiment of a system according to the present invention for drying particulate sugar beet pulp according to a second embodiment of the present invention.

FIG. 2 illustrates a system for drying particulate sugar beet pulp according to a first and presently preferred embodiment of the method and the system according to the present invention. In FIGS. 2 and 3, components and elements identical to components and elements, respectively, described above with reference to FIG. 1 are designated by the same reference numerals as used above, and components or elements similar to, however differing from the components or elements, respectively, of the known system disclosed with reference to FIG. 1 have been given the same number indexing as used above, but with a prime.

The first embodiment of the method and system according to the present invention shown in FIG. 2 basically differs from the above described known system in that the heat exchanger 22 of the known system is replaced by a heat exchanger assembly 90 comprising a first heat exchanger 94 and a second heat exchanger 92. In the heat exchanger 90, the first heat exchanger 94 is positioned above the second heat exchanger 92 and consequently receives the superheated steam circulating within the closed container 24 prior to guiding the superheated steam downwardly through the channel or the plurality of channels defined within the heat exchanger assembly to the second heat exchanger 92. By employing two heat exchangers in accordance with the teachings of the present invention in the steam dryer, a substantive efficiency increase is obtained, as will be illustrated below with reference to FIGS. 4 and 5.

The first steam conduit 16 supplies the primary flow of steam 18 to the second heat exchanger 92 or the lowermost heat exchanger of the heat exchanger assembly 90. The second heat exchanger 92 transfers the heat of the primary flow of steam 18 to the atmosphere inside the closed container 24, in which process it is condensed into the flow of condensed water 38. The hot water outlet 40 leads the flow of condensed water 38 out of the steam dryer 30' to the flasher 42'. In the flasher 42', a first flow of fluid 108 is divided from the flow of condensed water 38 by a first flow generator 106 and is led via a first fluid conduit 110 to the first heat exchanger 94. The first heat exchanger 94 transfers heat from the first flow of fluid 108 to the atmosphere inside the closed container 24.

Within the first heat exchanger 94, the water of the first flow of fluid 108 is cooled and discharged as a cooled water fluid 96 via a water conduit 98 and a pressure reduction valve 100 to the flasher 42.

The position of the second heat exchanger 92 downstream of the first heat exchanger 94 with respect to the flow of superheated steam and the output of the second heat exchanger 92 is used to form the input to the first heat exchanger 94 has the effect that the latter functions as a pre-heater for the former, which improves the energy efficiency of the system by more than 10%.

FIG. 3 illustrates a system for drying particulate sugar beet pulp according to a second embodiment of the method and the system according to the present invention.

The second embodiment of the method and the system according to the present invention shown in FIG. 3 basically differs from the above described first embodiment of the method and the system according to the present invention in that the first heat exchanger 94', similar to the first heat exchanger 94 shown in FIG. 2, is supplied with steam generated by the flasher 42' rather than supplied with hot water from the hot water outlet 40 of the second heat exchanger 92. In the second embodiment of the method and system according to the present invention shown in FIG. 3, the flow or fluid 74 in the form of steam from flasher 42, in which hot water from the first and second heat exchangers 94' and 92', respectively, of the heat exchanger assembly 90', is separated into the steam component 44' and the water component 46'. From the fluid conduit 76 leading the flow or fluid 74 in the form of steam from the steam component generated by the flasher 42', a branch off conduit 118 leads steam to the first heat exchanger 94'. Above the branch off from the fluid conduit 76, a pressure reduction valve 116 is provided. The outlet from the first heat exchanger 94' of the heat exchanger assembly 90' shown in FIG. 3 conducts water 96' through a water conduit 98' to the flasher 42', whereas in the conduit 108 conducting hot water from the hot water outlet 40, a pressure reduction valve 100' is provided as distinct from the above described first embodiment, in which the pressure reduction valve 100 is located in the conduit 98.

Figure 4:
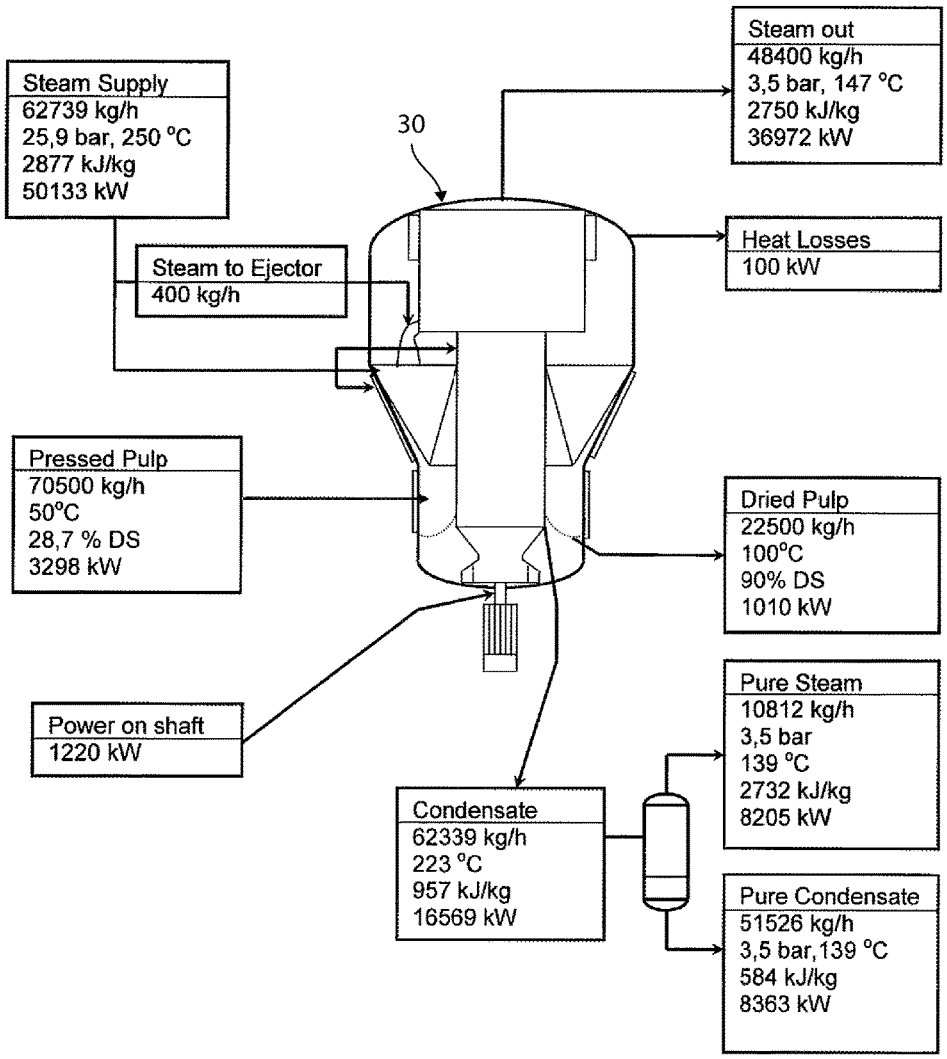
(PRIOR ART) FIG. 4
FIG. 4 illustrates an example of the driving conditions for the known system shown in FIG. 1 for drying particulate sugar beet pulp.

In FIG. 4, the dryer 30 shown in FIG. 1 is illustrated in a schematic view, in which the steam dryer's mass and energy balance are indicated. The steam dryer is, as said above, a conventional dryer size H from the applicant company having the capacity of evaporating 48,400 kg/h at a supply pressure of 25.9 bar.

Figure 5:
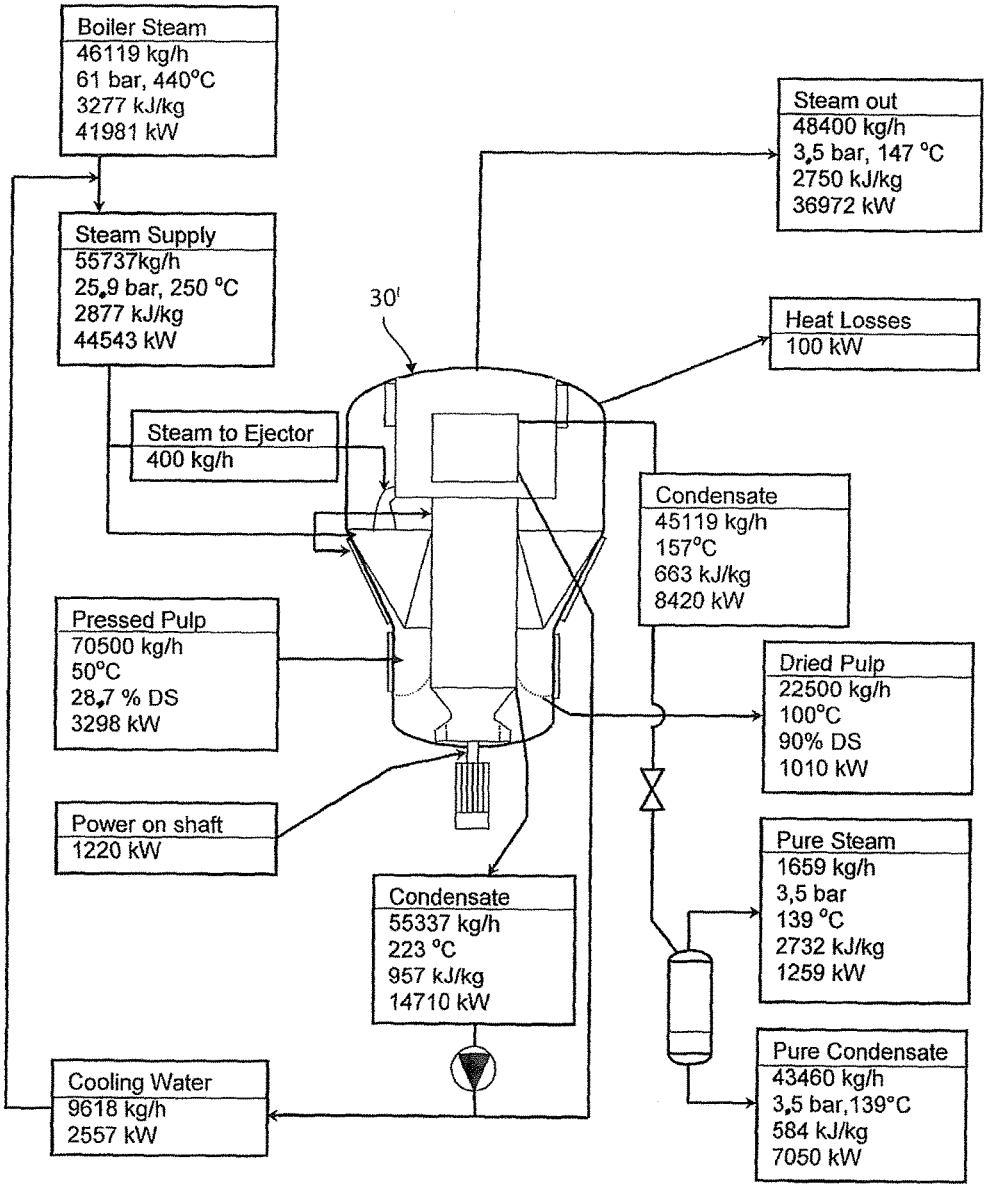
FIG. 5 illustrates an example of the driving conditions for the first embodiment of the system shown in FIG. 2 for drying particulate sugar beet pulp.

Similarly, in FIG. 5, for the first and presently preferred embodiment of the steam dryer of the method and system according to the present invention described above with reference to FIG. 2, there is illustrated the energy and mass balance of the steam dryer constituting a modified dryer size H from the applicant company having the same capacity as the steam dryer size H shown in FIG. 4, namely the capacity of evaporating 48,400 kg/h at a supply pressure of 25.9 bar.

From FIGS. 4 and 5, it readily appears that the energy supplied to the known steam dryer 30 shown in FIG. 4 amounts to 50.133 kW, whereas the net energy input to the steam dryer 30' shown in FIG. 5 amounts to 44.543 kW. Consequently, the amount of energy needed for the two dryers differ by approximately 5.500 kW constituting an energy saving of approximately 15%.

Figure 7:
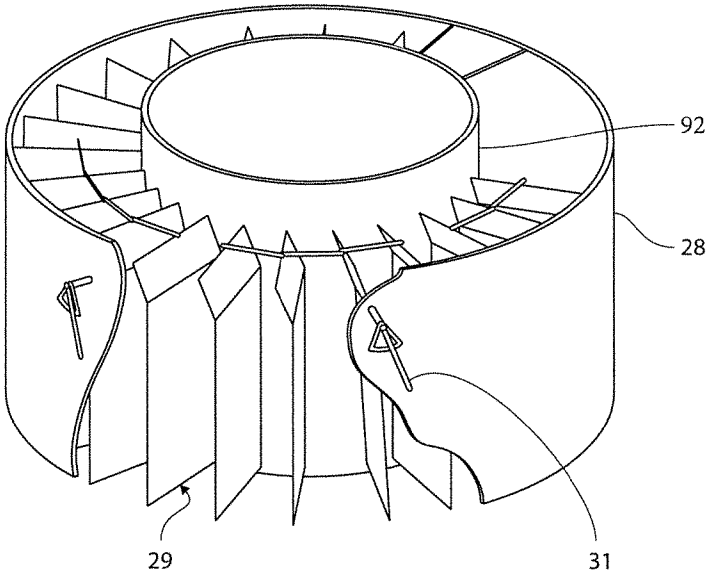
FIG. 7 illustrates a perspective view of a portion of the steam dryer shown in FIG. 6.
Figure 6:
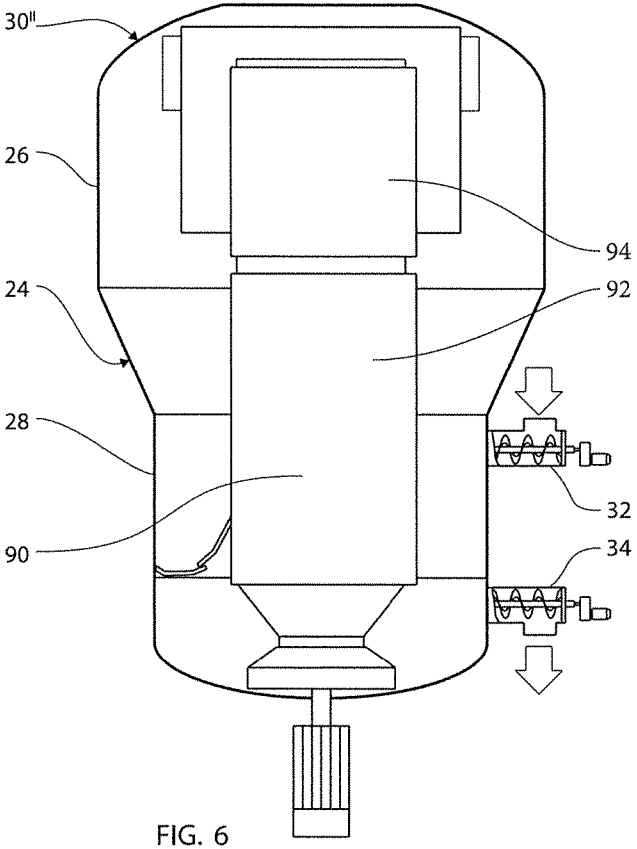
FIG. 6 illustrates details of a known steam dryer modified in accordance with the embodiments shown in FIGS. 2 and 3.

In FIGS. 6 and 7, details of the steam dryer 30', implemented in accordance with the teachings of the present invention, are shown, which steam dryer constitutes a modification of a steam dryer size H of the type previously delivered by the applicant company in 2005 to a major US sugar company located in Michigan. The modification of the previously-delivered steam dryer size H relates exclusively to the provision of the heat exchanger assembly 90 characteristic of the present invention as distinct from the single heat exchanger 22 of the known steam dryer 30. In FIG. 6, the steam dryer 30' is shown comprising the closed container 24 having the upper cylindrical part 26 and the lower cylindrical part 28 joint by a slim conical part. In the lower cylindrical part 28, the material inlet 32 is shown together with the material outlet 34. The material inlet 32 and the material outlet 34 are both configured as screw conveyors, and the arrows positioned above and below the material inlet 32 and the material outlet 34, respectively, indicate the inlet and outlet, respectively, of moist material and dry material, respectively.

In FIG. 7, the lower cylindrical part 28 of the steam dryer size H concept of the applicant company is shown. The features of the lower cylindrical part 28 shown in FIG. 7 were first implemented in a steam dryer size H delivered as stated above to a US sugar manufacturing company, and the feature relating to the guide walls of the lower cylindrical part 28 is equivalently applicable and useful in the steam dryer 30' implemented with the feature characteristic of the present invention, namely the presence of a heat exchanger assembly 90 having a first or upper heat exchanger 94 and a second or lower heat exchanger 92. In FIG. 7, the outer wall of the lower cylindrical part 28 of the steam dryer 30' is shown together with the outer wall of the second or lower heat exchanger 92 (not shown in FIG. 7) of the heat exchanger assembly 90. The inner space defined between the outer wall of the lower cylindrical part 28 and the outer wall of the second or lower heat exchanger 92 is separated into sections by guide walls, one of which is designated by the reference numeral 29. The guide walls each comprise a lower vertical part and an upper tiltable part, as a group of 3-5 upper tiltable parts of the guide walls may be tilted by the use of a handle 31, allowing the tiltable upper parts of the guide walls 29 to control the flow of material through the steam dryer, and, in doing so, optimizing the flow to the material in question as to its size and humidity.

Although the present invention has been described with reference to two advantageous embodiments, among which one constitutes the presently preferred embodiment, a person skilled in the art will readily recognize that the steam dryer itself may be implemented in numerous ways incorporating the technical features of, among others, the steam dryers known from the publications mentioned in the introduction to the present specification. Any such modification or use of the teachings of the present invention in combination with a prior art steam dryer is consequently to be considered part of the present invention and to be construed encompassed by the protective scope defined in the appending points.

Points Characterizing the Invention:

1. A method of drying humid or moist particulate material, said method comprising:

providing a supplier of pressurized steam, and a steam dryer for drying said moist particulate material, said steam dryer comprising:

a closed container maintaining an atmosphere comprising superheated steam at an elevated pressure, said closed container comprising a lower cylindrical part and an upper cylindrical part; and a heat exchanger assembly located inside said closed container and comprising a channel for allowing said superheated steam to be transported from inside said upper cylindrical part to inside said lower cylindrical part, said heat exchanger assembly comprising a first heat exchanger and a second heat exchanger for heating said superheated steam, said first heat exchanger being positioned above said second heat exchanger, and said channel going down through said first and second heat exchangers;

said method comprising:

supplying a primary flow of steam from said supplier to said second heat exchanger for heating said second heat exchanger and condensing said primary flow of steam within said second heat exchanger into a flow of condensed hot water;

discharging said flow of condensed hot water from said second heat exchanger;

generating a first flow of fluid exclusively from said flow of condensed hot water;

leading said first flow of fluid to said first heat exchanger for heating said first heat exchanger;

generating a flow of said superheated steam going upward on the outside of said heat exchanger assembly to the inside of said upper cylindrical part and downward through said channel;

feeding said moist particulate material into said closed container;

guiding said moist particulate material along a path around said heat exchanger assembly for subjecting said humid particulate material to said flow of said super heated steam for converting said moist particulate material into dry particulate material; and removing said dry particulate material from said first container.

2. The method according to point 1, said generating of said first flow of fluid comprising:

forming said first flow of fluid comprising said flow of condensed hot water or at least a part of said condensed hot water.

3. The method according to point 1, said generating of said first flow of fluid comprising:

separating said flow of condensed hot water into a first steam component and a first water component; and forming said first flow of fluid comprising said first steam component or at least a part of said first steam component.

4. The method according to point 2, further comprising:

leading a second flow of fluid from said first heat exchanger, said second flow of fluid comprising water from said first flow of fluid; and separating a second steam component and a second water component from said second flow of fluid.

5. The method according to point 4, said supplier of pressurized steam being a boiler, and said method further comprising:

forming a third flow of fluid from said second water component;

leading said third flow of fluid to said boiler; and generating at least a portion of said pressurized steam from said third flow of fluid in said boiler.

6. The method according to point 2 or point 4 or point 5, further comprising:

forming a fourth flow of fluid from said flow of condensed hot water;

leading said fourth flow of fluid to said primary flow of steam; and mixing said fourth flow of fluid into said primary flow of steam.

7. The method according to point 3, further comprising:

forming a fifth flow of fluid from said first water component and/or leading a sixth flow of fluid from said first heat exchanger comprising water condensed from said first flow of fluid; and separating a third steam component and a third water component from said fifth flow of fluid and/or said sixth flow of fluid.

8. The method according to point 7, said supplier of pressurized steam being a boiler, and said method further comprising:

forming a seventh flow of fluid from said third water component;

leading said seventh flow of fluid to said boiler; and generating at least a portion of said pressurized steam from said seventh flow of fluid in said boiler.

9. The method according to point 3 or any point referencing point 3, further comprising:

forming an eighth flow of fluid from said first water component;

leading said eighth flow of fluid to said primary flow of steam; and mixing said eighth flow of fluid into said primary flow of steam.

10. The method according to any of the points 1 to 9, further comprising:

providing a primary evaporation unit for reducing the water content of a first juice comprising sugar; and leading a first exhaust flow from said closed container to said primary evaporation unit for heating said primary evaporation unit, said first exhaust flow comprising steam from said superheated steam.

11. The method according to any of the points 1 to 10, further comprising:

providing a secondary evaporation unit for reducing the water content of a second juice comprising sugar; and supplying a secondary flow of steam from said supplier to said secondary evaporation unit for heating said secondary evaporation unit.

12. The method according to points 10 and 11, further comprising:

providing said first juice as input to said primary evaporation unit;

providing said second juice as output from said primary evaporation unit, said second juice comprising sugar from said first juice; and providing said second juice as input to said secondary evaporation unit.

13. The method according to points 10 to 11 or 10 to 12, further comprising:

providing a tertiary evaporation unit for reducing the water content of a third juice comprising sugar; and/or leading a second exhaust flow from said primary evaporation unit to said tertiary evaporation unit for heating said tertiary evaporation unit, said second exhaust flow comprising steam evaporated from said first juice; and/or leading a third exhaust flow from said secondary evaporation unit to said tertiary evaporation unit for heating said tertiary evaporation unit, said third exhaust flow comprising steam evaporated from said second juice.

14. The method according to point 13, further comprising:

providing said third juice as output from said secondary evaporation unit, said third juice comprising sugar from said second juice; and providing said third juice as input to said tertiary evaporation unit.

15. The method according to point 4 or any point depending on point 4 and point 11 or any point depending on point 11, further comprising:

forming a ninth flow of fluid from said second steam component; and leading said ninth flow of fluid to said secondary evaporation unit for heating said secondary evaporation unit.

16. The method according to point 7 or any point depending on point 7 and point 11 or any point depending on point 11, further comprising:

forming a tenth flow of fluid from said third steam component; and leading said tenth flow of fluid to said secondary evaporation unit for heating said secondary evaporation unit.

17. A system of drying moist particulate material, said system comprising:

a supplier of pressurized steam, and a steam dryer for drying said moist particulate material, said steam dryer comprising:

a closed container for maintaining an atmosphere comprising superheated steam at an elevated pressure, said closed container comprising a lower cylindrical part and an upper cylindrical part;

a heat exchanger assembly located inside said closed container and comprising a channel for allowing said superheated steam to be transported from inside said upper cylindrical part to inside said lower cylindrical part, said heat exchanger assembly comprising a first heat exchanger and a second heat exchanger for heating said superheated steam, said first heat exchanger being positioned above said second heat exchanger and said channel going down through said first and second heat exchangers;

an impeller for generating a flow of said superheated steam going upward on the outside of said heat exchanger assembly to the inside of said upper cylindrical part and downward through said channel;

a material inlet for feeding said moist particulate material into said closed container;

a plurality of guide plates positioned upright and circumferentially around said heat exchanger assembly for guiding said moist particulate material along a path around said heat exchanger assembly for subjecting said moist particulate material to said flow of said superheated steam for converting said moist particulate material into dry particulate material; and a material outlet for removing said dry particulate material from said first container; and said system further comprising:

a first steam conduit for supplying a primary flow of steam from said supplier to said second heat exchanger for heating said second heat exchanger, said second heat exchanger being adapted for condensing said primary flow of steam into a flow of condensed hot water;

a hot water outlet for discharging said flow of condensed hot water from said second heat exchanger;

a first flow generator for generating a first flow of fluid exclusively from said flow of condensed hot water; and a first fluid conduit for leading said first flow of fluid to said first heat exchanger for heating said first heat exchanger.

18. The system according to point 17, said first flow generator being adapted for forming said first flow of fluid comprising said flow of condensed hot water or at least a part of said condensed hot water.

19. The system according to point 17, said first flow generator comprising:

a first flasher for separating said flow of condensed hot water into a first steam component and a first water component; and said first flow generator being adapted for forming said first flow of fluid comprising said first steam component or at least a port of said first steam component.

20. The system according to point 18, further comprising:

a second fluid conduit for leading a second flow of fluid from said first heat exchanger to a second flasher for separating a second steam component and a second water component from said second flow of fluid, said second flow of fluid comprising water from said first flow of fluid.

21. The system according to point 20, said supplier of pressurized steam being a boiler, said second flasher further being adapted for forming a third flow of fluid from said second water component, said system further comprising:

a third fluid conduit for leading said third flow of fluid from said second flasher to said boiler; said boiler being adapted for generating at least a portion of said pressurized steam from said third flow of fluid in said boiler.

22. The system according to point 18 or any point referencing point 18, said first flow generator further being adapted for forming a fourth flow of fluid from said flow of condensed hot water, said system further comprising:

a fourth fluid conduit for leading said fourth flow of fluid from said second flasher to said primary flow of steam; and a first mixer for mixing said fourth flow of fluid into said primary flow of steam.

23. The system according to point 19, said first flasher further being adapted for forming a fifth flow of fluid from said first water component, said system further comprising:

a third flasher;

a fifth fluid conduit for leading said fifth flow of fluid from said first flasher to said third flasher, and/or a sixth fluid conduit for leading a sixth flow of fluid from said first heat exchanger to said third flasher, said sixth flow of fluid comprising water condensed from said first flow of fluid, and said third flasher being adapted for separating a third steam component and a third water component from said fifth flow of fluid and/or said sixth flow of fluid.

24. The system according to point 23, said supplier of pressurized steam being a boiler, said third flasher further being adapted for forming a seventh flow of fluid from said third water component, said system further comprising:

a seventh fluid conduit for leading said seventh flow of fluid from said third flasher to said boiler; said boiler further being adapted for generating at least a portion of said pressurized steam from said seventh flow of fluid in said boiler.

25. The system according to point 19 or any point referencing point 19 characterized in the first flasher further being adapted for forming an eighth flow of fluid from said first water component, said system further comprising:

an eighth fluid conduit for leading said eighth flow of fluid from said third flasher to said primary flow of steam; and a second mixer for mixing said eighth flow of fluid into said primary flow of steam.

26. The system according to any of the points 17 to 25, further comprising:

a primary evaporation unit for reducing the water content of a first juice comprising sugar; and a first exhaust conduit for leading a first exhaust flow from said closed container to said primary evaporation unit for heating said primary evaporation unit, said first exhaust flow comprising steam from said superheated steam.

27. The system according to any of the points 17 to 26, further comprising:

a secondary evaporation unit for reducing the water content of a second juice comprising sugar; and a second steam conduit for supplying a secondary flow of steam from said supplier to said secondary evaporation unit for heating said secondary evaporation unit.

28. The system according to points 26 and 27, further comprising:

a first juice conduit for leading said first juice to said primary evaporation unit;

a first juice inlet for receiving said first juice as input to said primary evaporation unit;

a first juice outlet for removing said second juice as output from said primary evaporation unit, said second juice comprising sugar from said first juice;

a second juice conduit for leading said second juice to said secondary evaporation unit; and a second juice inlet for receiving said second juice as input to said secondary evaporation unit.

29. The system according to points 26 to 27 or 26 to 28, further comprising:

a tertiary evaporation unit for reducing the water content of a third juice comprising sugar;

a second exhaust conduit for leading a second exhaust flow from said primary evaporation unit to said tertiary evaporation unit for heating said tertiary evaporation unit, said second exhaust flow comprising steam evaporated from said first juice; and a third exhaust conduit for leading a third exhaust flow from said secondary evaporation unit to said tertiary evaporation unit for heating said tertiary evaporation unit, said third exhaust flow comprising steam evaporated from said second juice.

30. The system according to point 29, further comprising:

a second juice outlet for removing said third juice as output from said secondary evaporation unit, said third juice comprising sugar from said second juice;

a third juice conduit for leading said third juice to said tertiary evaporation unit;

a third juice inlet for receiving said third juice as input to said tertiary evaporation unit.

31. The system according to point 20 or any point depending on point 20 and point 27 or any point depending on point 27 characterized by said second flasher further being adapted for forming a ninth flow of fluid from said second steam component, said system further comprising:

a ninth fluid conduit for leading said ninth flow of fluid to said secondary evaporation unit for heating said secondary evaporation unit.

32. The system according to point 23 or any point depending on point 23 and point 27 or any point depending on point 27 characterized by said third flasher further being adapted for forming a tenth flow of fluid from said third steam component, said system further comprising:

a tenth fluid conduit for leading said tenth flow of fluid to said secondary evaporation unit for heating said secondary evaporation unit.

The invention claimed is:

1. A system for drying moist particulate material, comprising:

a single supplier of pressurized steam;

a closed container configured for maintaining within it an atmosphere comprising superheated steam at an elevated pressure, the closed container comprising a lower part and an upper part;

a heat exchanger assembly in the closed container and comprising a first heat exchanger positioned above a second heat exchanger, wherein both the first heat exchanger and the second heat exchanger are configured for heating the superheated steam, and wherein the first heat exchanger is (a) fluidly isolated from the single supplier of pressurized steam, and (b) configured as a pre-heater for the second heat exchanger;

a first steam conduit fluidly connecting the second heat exchanger to the single supplier of pressurized steam so as to provide a primary flow of pressurized steam from the single supplier of pressurized steam to the second heat exchanger, the second heat exchanger being configured to condense the primary flow of pressurized steam into a flow of hot water;

a channel going through the first heat exchanger and the second heat exchanger and configured for conducting the superheated steam from inside the upper part of the closed container to inside the lower part of the closed container;

an impeller configured for generating a flow of the superheated steam going upward on the outside of the heat exchanger assembly to the inside of the upper part of the closed container and downward through the channel;

a material inlet configured for feeding the moist particulate material into the lower part of said closed container;

a plurality of guide plates positioned upright and circumferentially around the heat exchanger assembly and configured for guiding the moist particulate material along a path around the heat exchanger assembly to subject the moist particulate material to the flow of the superheated steam, thereby to convert the moist particulate material into dry particulate material;

a material outlet configured for removing the dry particulate material from the closed container;

a hot water outlet in the closed container configured for discharging the flow of hot water from the second heat exchanger out of the closed container;

a heated fluid conduit fluidly connecting the hot water outlet to the first heat exchanger and configured to provide a flow of heated fluid from the flow of hot water to pre-heat the superheated steam in the first heat exchanger solely with the flow of heated fluid to the first heat exchanger configured as the pre-heater for the second heat exchanger.

2. The system of claim 1, wherein the heated fluid comprises hot water, and wherein the heated fluid conduit includes a flow generator.

3. The system of claim 1, wherein the heated fluid conduit includes a flasher, and wherein the heated fluid comprises steam generated by the flasher.

4. The system of claim 3, wherein the flasher is configured for separating the flow of hot water into a steam component and a water component, and for forming the flow of heated fluid as comprising at least a portion of the steam component.

5. A method of drying moist particulate material, the method comprising:

(a) providing a single supplier of pressurized steam;

(b) providing a steam dryer, comprising:

(i) a closed container maintaining an atmosphere comprising superheated steam at an elevated pressure, the closed container comprising a lower part and an upper part;

(ii) a heat exchanger assembly located inside the closed container and comprising a channel configured for allowing the superheated steam to be transported from inside the upper part to inside the lower part, the heat exchanger assembly comprising an upper heat exchanger in the upper part of the container and a lower heat exchanger in the lower part of the container, wherein the upper heat exchanger is fluidly isolated from the single supply of pressurized steam, and wherein the channel extends through the upper heat exchanger and the lower heat exchanger; and (iii) a plurality of guide plates positioned upright and circumferentially around the heat exchanger assembly;

(c) directly supplying a primary flow of pressurized steam from the single supplier of pressurized steam exclusively to the lower heat exchanger for heating the lower heat exchanger;

(d) condensing the primary flow of steam within the lower heat exchanger into a flow of hot water;

(e) discharging the flow of hot water from the lower heat exchanger;

(f) generating a first flow of heated fluid from the flow of hot water;

(g) providing the first flow of heated fluid to the upper heat exchanger to pre-heat the superheated steam in the upper heat exchanger solely by heat transfer from the heated fluid;

(h) generating a flow of said superheated steam going upward on the outside of the heat exchanger assembly to the inside of the upper part and downward through the channel;

(i) feeding moist particulate material into the lower part of the closed container;

(j) guiding the moist particulate material by means of the plurality of guide plates along a path around the heat exchanger assembly carried by the flow of the superheated steam, thereby subjecting the moist particulate material to the flow of the superheated steam for converting the moist particulate material into dry particulate material; and (k) removing the dry particulate material from the closed container.

6. The method of claim 5, wherein generating the first flow of fluid comprises:

separating the flow of hot water into a first steam component and a first water component; and forming the first flow of fluid comprising at least a part of the first steam component.

7. The method of claim 5, wherein generating the first flow of fluid comprises:

forming the first flow of fluid comprising at least a part of the flow of hot water.

8. The method of claim 7, further comprising:

leading a second flow of heated fluid from the upper heat exchanger, the second flow of heated fluid comprising water from the first flow of heated fluid; and separating a steam component and a water component from the second flow of heated fluid.

9. The method of claim 8, further comprising:

forming a third flow of heated fluid from the water component of the second flow of heated fluid;

leading the third flow of heated fluid to the single supplier of pressurized steam; and generating at least a portion of the pressurized steam from the third flow of heated fluid in the single supplier of pressurized steam.

10. The method of claim 9, further comprising:

forming a fourth flow of heated fluid from the flow of hot water;

leading the fourth flow of heated fluid to the primary flow of pressurized steam; and mixing the fourth flow of heated fluid into the primary flow of pressurized steam.

11. The method of claim 5, further comprising:

providing a first exhaust flow of steam from the closed container, the first exhaust flow of steam comprising steam from the superheated steam; and using the first exhaust flow of steam to reduce the water content of a first juice comprising sugar by evaporation to produce a second juice having an increased sugar concentration relative to the first juice.

12. The method of claim 11, further comprising:

providing a secondary flow of steam from the single supplier of pressurized steam; and using the secondary flow of steam to reduce the water content of the second juice by evaporation to produce a third juice having an increased sugar concentration relative to the second juice.

13. The method of claim 12, further comprising:

providing a second exhaust flow of steam from the water evaporated from the first juice;

providing a third exhaust flow of steam from the water evaporated from the second juice; and using the second and third exhaust flows of steam to reduce the water content of the third juice by evaporation.

* * * * *